US005685699A

United States Patent [19]

Holmes et al.

[11] Patent Number: 5,685,699

[45] Date of Patent: Nov. 11, 1997

[54] COMPRESSOR TRANSMISSION VENT SYSTEM

[75] Inventors: Cornelius Holmes, North Syracuse; Vishnu Sishtla, Cicero, both of N.Y.; Jarso Mulugeta, Baltimore, Md.

[73] Assignee: Carrier Corporation, Syracuse, N.Y.

[21] Appl. No.: 665,665

[22] Filed: Jun. 20, 1996

[51] Int. Cl.[6] ..... F04B 17/03

[52] U.S. Cl. ..... 417/423.1; 29/888.024

[58] Field of Search ..... 417/423.1, 423.11, 417/423.12, 423.13, 423.14; 29/888.02, 888.021, 888.024, 888.025; 415/117

[56] References Cited

U.S. PATENT DOCUMENTS

| | | | |
|---|---|---|---|
| 3,163,999 | 1/1965 | Ditzler et al. | 417/423.13 |
| 3,650,634 | 3/1972 | Osborne et al. | 417/423.13 |
| 3,853,433 | 12/1974 | Roberts et al. | 417/423.13 |
| 4,997,340 | 3/1991 | Zinsmeyer et al. | 415/105 |
| 5,525,039 | 6/1996 | Sieghartner | 417/423.13 |
| 5,549,459 | 8/1996 | Nixon | 417/423.12 |

*Primary Examiner*—Timothy Thorpe
*Assistant Examiner*—Peter G. Korytnyk

[57] ABSTRACT

An improved transmission vent system for centrifugal compressors comprises a motor compartment, a transmission chamber, an impeller for moving refrigerant in a downstream direction, a guide vane located upstream of the impeller, and a vent pipe connected between the transmission chamber and an area upstream of the impeller and downstream of the guide vane. Refrigerant can be vented from transmission chamber to the area upstream of the impeller and downstream of the guide vane in order to eliminate the pressure differential between the transmission chamber and the compressor suction area upstream of the impeller during start-up.

5 Claims, 4 Drawing Sheets

COMPRESSOR TRANSMISSION VENT SYSTEM

FIELD OF TECHNOLOGY

This invention relates generally to centrifugal compressors and, more particularly, to a method and apparatus for an improved transmission vent system for centrifugal compressors.

BACKGROUND AND SUMMARY

Centrifugal compressors are used to compress refrigerant for water cooled chiller applications. An oil-lubricated transmission is part of the total apparatus, and problems can develop when refrigerant gets into the oil, and when oil gets into the refrigerant.

It is desirable to retain all of the oil in the transmission chamber and oil sump so that oil does not mix with the refrigerant in the cooler. Various methods of achieving this are used in the art, with varying degrees of success. For example, during operation, the transmission chamber and oil sump can be kept slightly below the pressure of the motor chamber. However, a problem arises at start-up when everything is the same pressure. The compressor differential that usually keeps the oil in its place doesn't yet exist. Indeed, at start-up the oil is briefly raised to a higher pressure and thus oil tends to leak into any area where the pressure is lower than in the oil-holding areas. Typically, oil can leak into the motor chamber and the impeller area.

To illustrate the problem, in order to counteract the aerodynamic thrust that is developed by the impeller of a centrifugal compressor, it is well known to employ a balance piston consisting of a low pressure cavity behind the impeller wheel. Because of the tendency for lubricating oil to leak from the transmission into this low pressure area, it is also common practice to install a seal device between the balance piston and the transmission. A mechanical seal, such as a carbon face seal, is typically used for this purpose. An alternative is a labyrinth seal that is simple, rugged, inexpensive and, since it is noncontacting, there are virtually no mechanical losses due to rubbing. A disadvantage, however, is that in order to be entirely effective, it is necessary to pressurize the labyrinth seal. One known way to do so in a centrifugal compressor is to fluidly connect a source of high pressure gas from the discharge line to the center of the labyrinth. In this way, oil leakage from the transmission during operation is substantially reduced. Problems with a labyrinth seal arrangement are noted and addressed in U.S. Pat. No. 4,997,340 to Sishtla (one of the present co-applicants), which is assigned to a common assignee as the present invention, and is incorporated herein by reference. During operation, the labyrinth seal is pressurized with refrigerant vapor from the motor chamber, which vapor is at a pressure slightly above that in the transmission chamber, thus minimizing the efficiency losses that would otherwise occur from leakage of the vapor into the transmission and to the compressor suction. However, the labyrinth seal still does not eliminate the problem of oil leakage at start-up, because before start-up all areas are at the same pressure, and during start-up a compressor suction area immediately upstream of the impeller and downstream of guide vanes is temporarily at a lower pressure than the oil-fed transmission chamber. The motor chamber is at the same pressure as the transmission chamber, hence oil leaks toward the impeller.

Another problem with greater pressure in the transmission chamber at start-up is that the higher the pressure in the transmission chamber and oil sump (the oil sump is normally in fluid communication with the transmission chamber), the more easily refrigerant gets dissolved into the oil. A higher amount of refrigerant in the oil decreases the viscosity of the oil-refrigerant mixture. As a result, when the oil gets to the bearings the film thickness between the shaft and the bearings is less, thereby increasing wear of the bearings and eroding reliability and expected lifetime of the compressor. Reducing pressure in the transmission chamber at start-up would help alleviate this problem.

Having higher pressure in the transmission chamber during start-up and at low guide vanes during normal operation, when the guide vanes are closed, also keeps the refrigerant dense, which causes high windage loss in the transmission. Reducing pressure in the transmission chamber at start-up and low guide vane normal operation would help alleviate this problem as well.

It is therefore desired to reduce oil leakage from the transmission chamber. It is also desired to lower the pressure in the transmission chamber during start-up, in order to lower refrigerant density during that time, and thus to reduce windage loss in the transmission.

It is also desirable to help equalize the pressure in the transmission chamber with the pressure in the compressor suction area immediately upstream of the impeller during start-up as well as during subsequent operation.

It is also desirable to improve performance of the ejector at part-load conditions, and to reduce the thrust loading by reducing force at the shaft end near the high speed pinion.

It is further desirable to reduce the amount of refrigerant that gets mixed in with in the oil, in order to increase oil film thickness in the bearings.

At least some, if not all, of the above desired results are achieved by the present invention of an apparatus and method for an improved transmission vent system for centrifugal compressors, comprising a motor compartment, a transmission chamber, an impeller for moving refrigerant in a downstream direction, a guide vane located upstream of the impeller, and a vent pipe connected between the transmission chamber and an area upstream of the impeller and downstream of the guide vane, such that refrigerant can be vented from transmission chamber to the area upstream of the impeller and downstream of the guide vane.

In the past, especially in low pressure machines in a typical water cooled chiller system, the transmission cavity was vented via a pipe to an area upstream of the guide vanes, as discussed above, rather than downstream of the guide vanes, because mineral oil was used. Normally, in the course of operation, refrigerant would mix in with the mineral oil. The sudden lowering of the pressure in the transmission chamber during start-up (as would occur if the transmission were vented to the area downstream of the guide vanes) would cause the refrigerant laden mineral oil to foam, causing a decrease in oil film thickness in the bearings, which in turn can cause shut-down of the compressor. However, synthetic oils are now being used, and the applicants discovered that foaming caused by reduction of pressure is reduced as a result, making the present invention more advantageous.

Venting the transmission to an area still upstream of the impeller, but downstream of the guide vanes, as in the present invention, helps reduce oil leakage by maintaining pressure in the transmission nearly equal to that upstream of impeller and downstream of guide vanes This results in reduced oil loss during operation, and especially during start-up. Secondly, at part-load conditions this arrangement will improve performance of the ejector due to the small constant pressure difference across it. The invention will also reduce the thrust loading, by reducing force on the shaft end near high speed pinion. The resulting decrease in transmission housing pressure will also reduce windage loss in the transmission by reducing the density of the refrigerant. Finally, at part-load, with lower pressure at 140° oil temperature, the amount of refrigerant mixing into the oil is reduced, which will increase oil film thickness in the bearings.

BRIEF DESCRIPTION OF THE DRAWINGS

To help explain the invention, a drawing comprising several figures is provided. For a fuller understanding of the nature and objects of the invention, reference should be made to the following detailed description to be read in connection with the accompanying figures of the drawing, in which.

DETAILED DESCRIPTION

Figure 1:
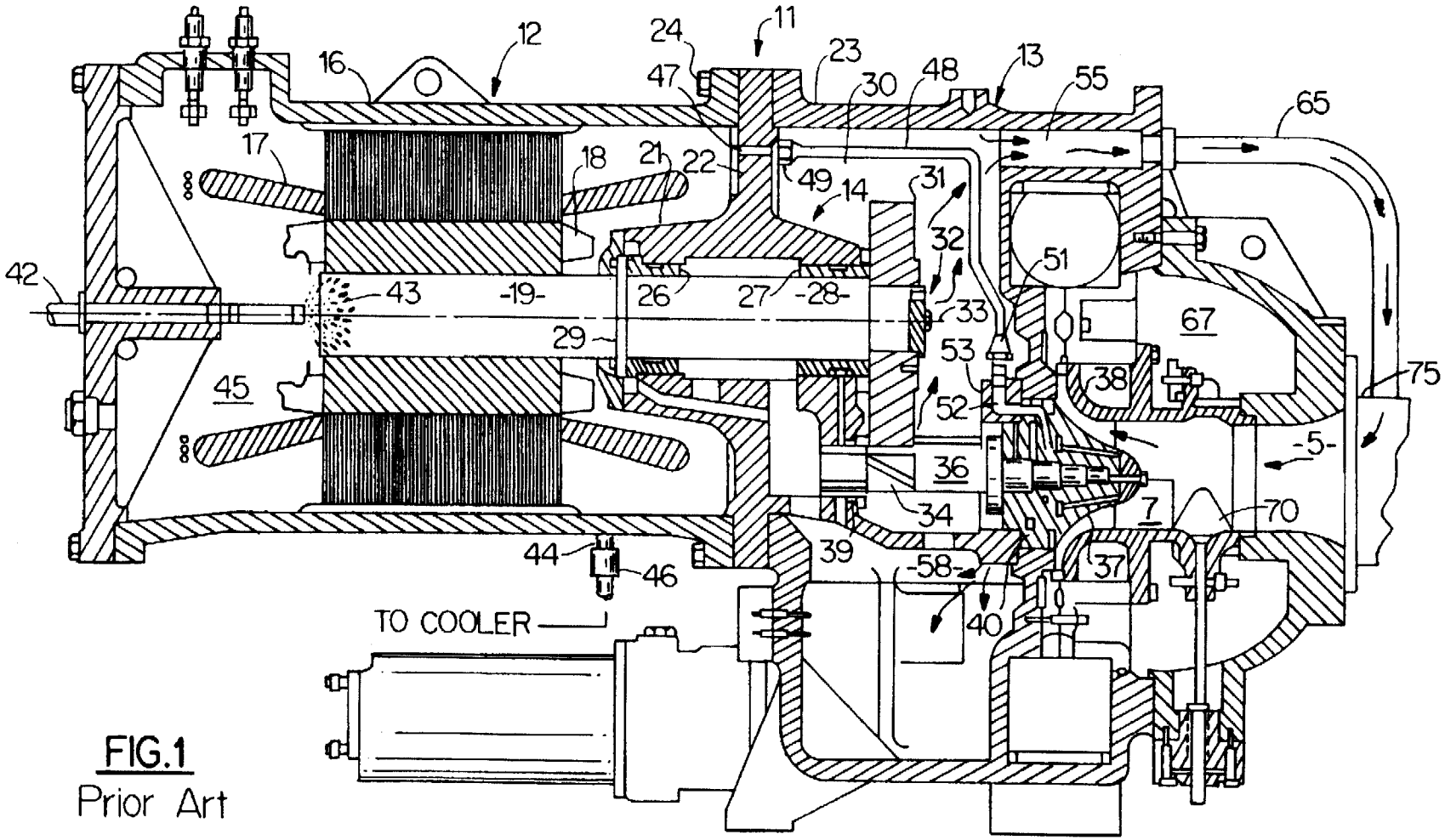
FIG.1 Prior Art
FIG. 1 is a longitudinal cross-sectional view of a conventionally configured centrifugal compressor.
Figure 2:
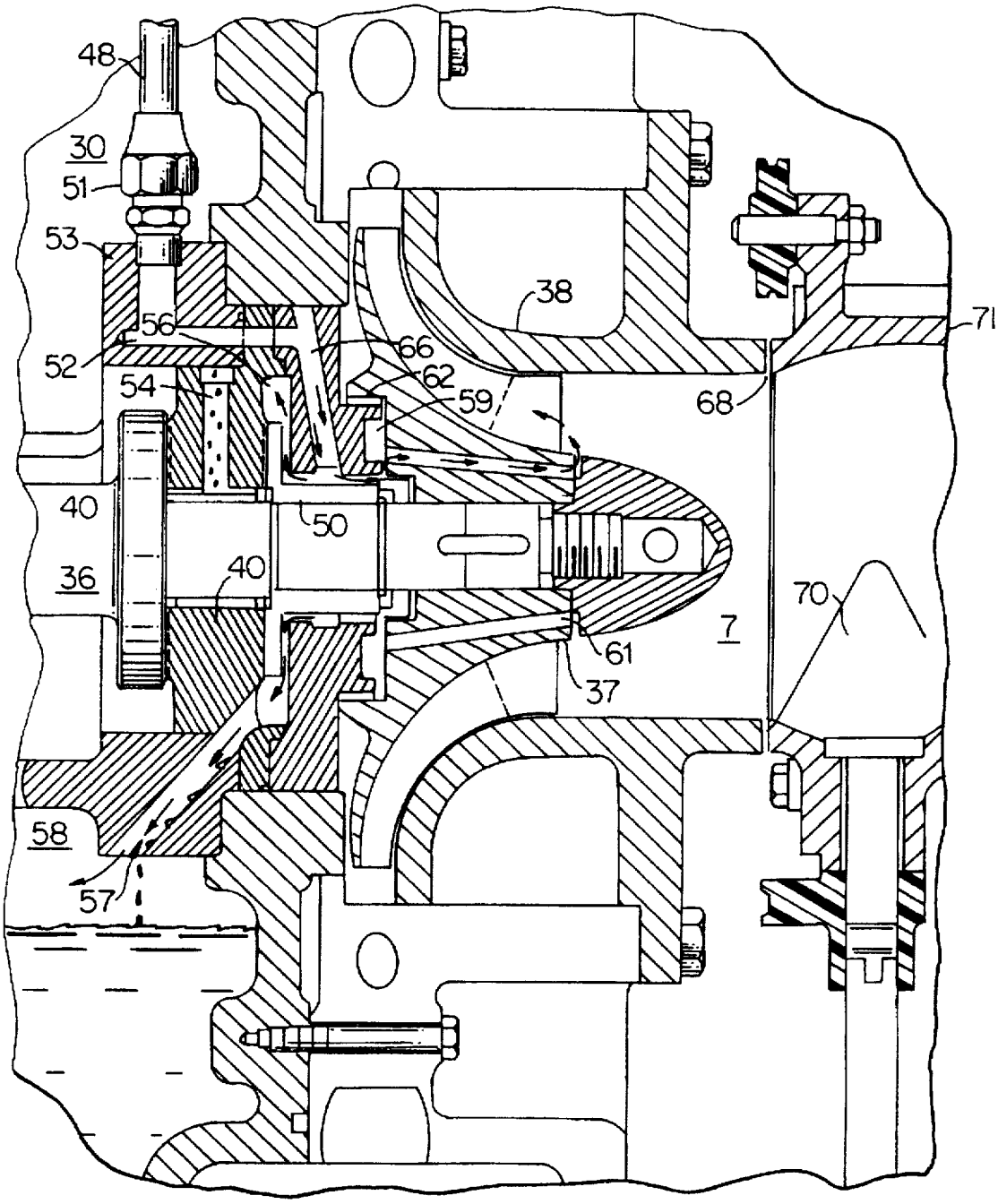
FIG. 2 is an enlarged longitudinal cross-sectional view of a portion of a centrifugal compressor showing details of the labyrinth seal portion, for use in understanding both the prior art and operation of the invention.
Figure 4:
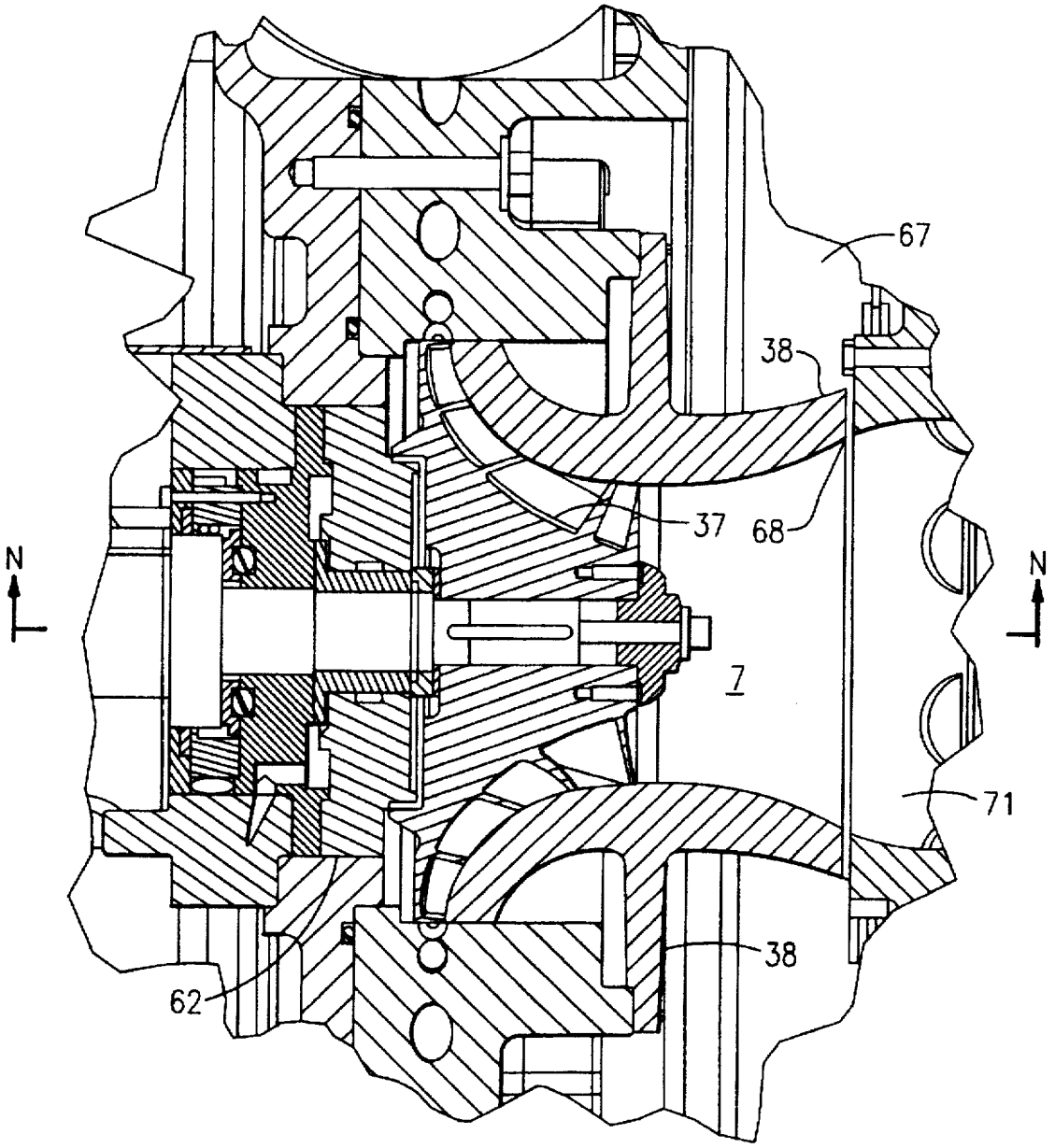
FIG. 4 is an enlarged longitudinal cross-sectional view of a portion of a centrifugal compressor showing details of the impeller portion, for use in understanding both the prior art and operation of the invention.

A conventionally configured centrifugal compressor is illustrated in longitudinal cross-section in FIG. 1. FIGS. 2 and 4, while not exclusively representing a conventionally configured centrifugal compressor, will also be useful in reference to the below discussion.

The centrifugal compressor system 11 shown has a motor 12 at its one end and a centrifugal compressor 13 at its other end, with the two being interconnected by a transmission assembly 14.

The motor 12 includes a motor casing 16 with a stator coil 17 disposed around its inner circumference. The rotor 18 is then rotatably disposed within the stator winding 17 by way of a rotor shaft 19 that is overhung from, and supported by, the transmission assembly 14. The transmission assembly 14 includes a transmission casing 21 having a radially extending annular flange 22 that is secured between the motor casing 16 and a compressor casing 23 by a plurality of bolts 24, with the transmission casing 21 and the compressor casing 23 partially defining a transmission chamber 30.

Rotatably mounted within the transmission casing 21, by way of a pair of axially spaced transmission bearings 26 and 27 is a transmission shaft 28 that is preferably integrally formed as an extension of the rotor shaft 19. A collar 29, that is an integral part of the shaft or attached by shrink fitting, is provided to transmit the thrust forces from the transmission shaft 28 to the thrust bearing portion of the transmission bearing 26. The end of transmission shaft 28 extends beyond the transmission casing 21 where a drive gear 31 is attached thereto by way of a retaining plate 32 and a bolt 33. The drive gear 31 engages a driven gear 34 that in turn drives an impeller shaft 36 for directly driving a compressor impeller 37. The impeller shaft 36 is supported by impeller bearings 39 and 40.

In order to reduce windage losses in the transmission 14 and to prevent oil losses from the transmission chamber 30, the transmission chamber 30 is vented by way of venting passage 55, venting pipe 65, and compressor suction pipe 75, to an area 5 upstream of guide vanes 70. As a result, at start-up, until guide vanes 70 open, the pressure downstream 7 of the guide vanes 70 and the compressor suction area 7 is less than the pressure in the transmission chamber 30.

In order to cool the motor 12, liquid refrigerant is introduced from the condenser 72 (not shown in FIG. 1) into one end of the motor 12 by way of an injection port 42. Liquid refrigerant, represented by the numeral 43, enters the motor chamber 45 and boils to cool the motor 12, with the refrigerant gas then returning to the cooler (not shown) by way of a conduit 44. A back pressure valve 46 is included in the conduit 44 in order to maintain a predetermined pressure differential between the motor chamber 45 and the cooler. Compressor suction pipe 75, at the point where transmission venting pipe 65 is connected, is typically at a lower pressure than the cooler. Thus, the pressure in the motor chamber 45 is higher than in the transmission chamber 30.

Communicating with the motor chamber 45 is an opening 47 in the annular flange 22 of the transmission casing 21. A line 48 is attached at its one end to the opening 47 by way of a standard coupling member 49. At the other end of the line 48 is another coupling member 51 which fluidly connects the line 48 to a seal pressurizing passage 52 formed in flange member 53 as shown in FIG. 1 and as can be better seen in FIG. 2. The impeller bearing 40 functions as both a journal bearing to maintain the radial position of the impeller shaft 36 and as a thrust bearing to maintain the axial position thereof. An oil feed passage 54 is provided as a conduit for oil flowing radially inwardly to the bearing surfaces, and an oil slinger 50 is provided to sling the oil radially outward from the impeller shaft 36. An annular cavity 56 then functions to receive the oil that is slung off from the impeller bearing 40 and to facilitate the drainage of oil through a drainage passage 57 and back to the oil sump 58.

In order to provide a counteraction to the aerodynamic thrust that is developed by the impeller 37, a "balance piston" is provided by way of a low pressure cavity 59 behind the impeller 37. An impeller passage 61 is provided in the impeller 37 in order to maintain the pressure in the cavity 59 at the same low pressure as the compressor suction area indicated generally by the numeral 7 and partially bounded by the suction housing shroud 38. This pressure (at the area 7 downstream of the guide vanes 70) typically varies from around 77 psia at full load, down to 40 psia at 10% load. Since the pressure in the transmission chamber 30 is higher (i.e., equal to the pressure of the compressor suction area 7 upstream of the guide vanes 70) than the pressure in the cavity 59, and especially at part-load operation, a labyrinth seal 62 with its associated teeth 63 is provided between the impeller bearing 40 and the impeller 37 to seal that area against the flow of oil from the transmission into the balance piston 59. This concept is well known, as is the further concept of pressurizing the labyrinth seal by exerting a high pressure gas thereon. If, as is customary, high pressure gas from the discharge line is used to pressurize the labyrinth seal 62, then the substantial pressure differential will cause the high pressure vapor, to flow from the labyrinth seal 62 to the low pressure sections of the system to thereby reduce the efficiency thereof. This flow can occur in two directions as indicated by the arrows in FIGS. 1 and 2. It can flow along impeller passage 61 to the compression suction area 7 or it can flow along drainage passage 57 to the oil sump 58, from where it can flow as indicated by the arrows in FIG. 1, through the venting passage 55, the venting pipe 65, the suction pipe 75, and finally, to the compressor suction area 7. In order to prevent these losses, the labyrinth seal 62 has instead been pressurized with the refrigerant vapor in the motor chamber 45, which vapor passes through the line 48, the seal pressurizing passage 52, and a passage 66 in the labyrinth seal 62. Thus, the labyrinth seal 62 is pressurized at the pressure of the motor chamber 45, which pressure is above the pressure of the transmission chamber 30. With this pressure differential being so minimized once the motor chamber 45 is pressurized, the losses that would result from the labyrinth pressurization gas leaking back into the transmission chamber 30 and eventually into the compressor suction area 7 is therefore also minimized once the motor chamber 45 is pressurized. Similarly, with the pressure differential between the labyrinth seal 62 and the compressor suction area 7 being minimized, the losses that result from the leakage of labyrinth pressurization gas leaking directly into the compressor suction area 7 by way of the impeller passage 61 is also minimized during operation during operation.

Figure 3:
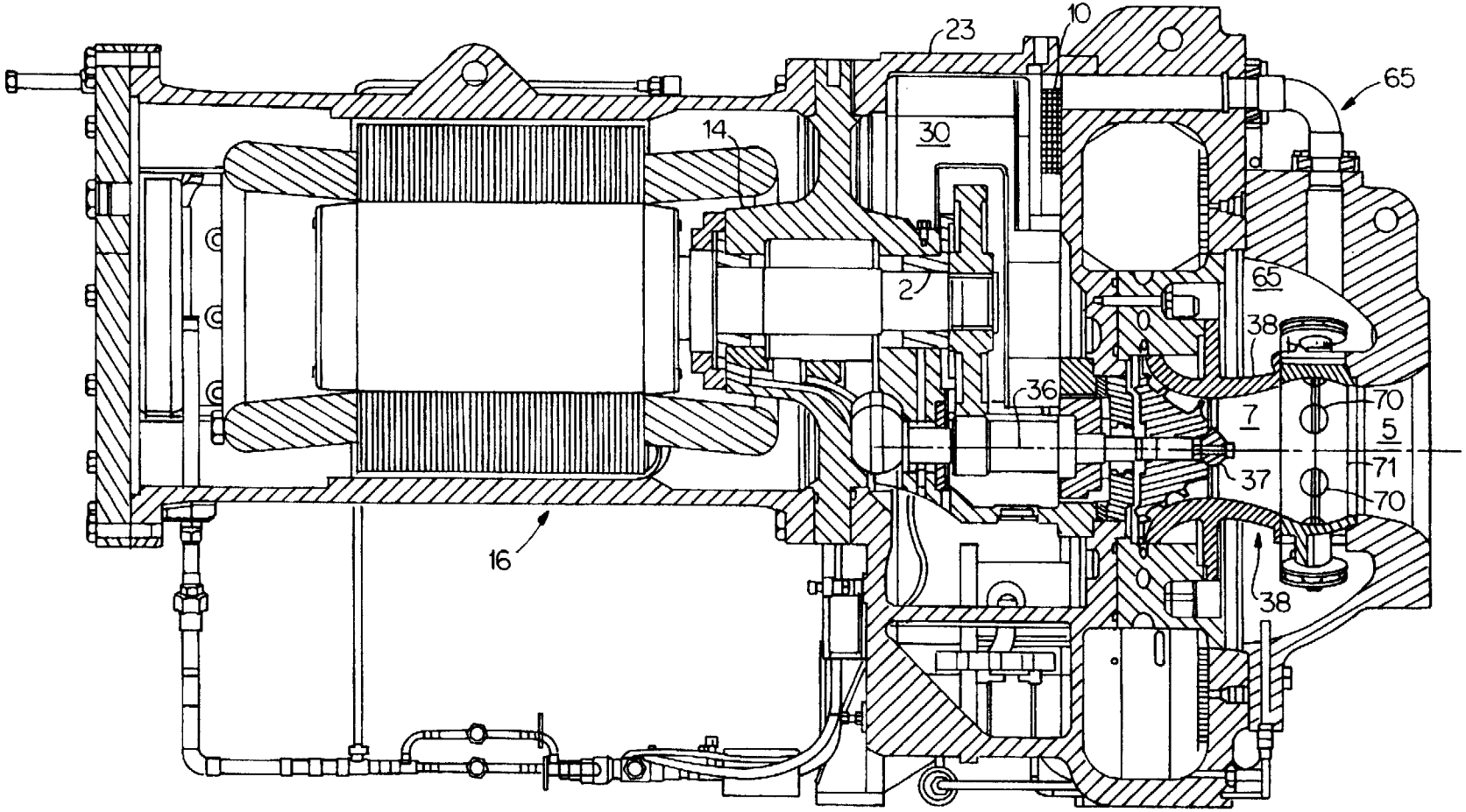
FIG. 3 is a longitudinal cross-sectional view of an embodiment of a centrifugal compressor according to the invention.

A centrifugal compressor configured according to an embodiment of the invention is now described with reference to FIGS. 2–4. Transmission chamber 30 vents through demister 10 (shown only in FIG. 3) into venting pipe 65, but now, instead of leading to suction pipe 75 upstream of guide vanes 70, venting pipe 65 leads to the suction housing cavity 67. The demister 10 keeps oil mist from the transmission chamber 30 from passing to the impeller. The pressure at the suction housing cavity 67 will be the same as the pressure in the compressor suction area 7 downstream of the guide vanes 70 because there is a gap 68 between the guide vane housing 71 and the suction housing shroud 38. Since the transmission chamber 30 now vents through venting pipe 65 and suction housing cavity 67 to the compressor suction area 7 downstream of the guide vanes 70, the pressure differential between the transmission chamber 30 and the compressor suction area 7 downstream of the guide vanes will now be eliminated, even during start-up. This also lowers the pressure in the transmission chamber 30 during start-up to below the pressure in the motor chamber 45. The higher pressure gas in the motor chamber 45 can pass through the line 48 to seal pressurizing passage 52, to help labyrinth seal 62 keep the oil contained in the transmission chamber 30.

During transients in the compressor such as surge, small amounts of oil will eventually get into the cooler or the evaporator. This oil can be reclaimed from the cooler with an oil reclaim system such as the one taught in U.S. Pat. No. 5,164,248 by the present inventor. This system works well with the guide vanes open, which is the normal position during operation at full load. At part-load when the guide vanes close, without the invention the suction housing is at a much lower pressure than the transmission because the transmission is vented to an area 5 upstream of the guide vanes in the prior conventional systems. As a result, the oil reclamation system has to switch between solenoid valves 1 and 2, which is complicated. However, with the new invention, this is no longer necessary because the pressure difference between the suction housing and the transmission area is always constant and is very low. This allows a simpler design for the oil reclamation system.

In a conventional system, when the guide vanes are closed, the pressure at the impeller shaft end (**36*a*) near the high speed pinion becomes much greater than the pressure in front of the impeller resulting in higher axial thrust. The thrust bearing (impeller bearing 40) then carries a much greater load and this causes higher power loss during operation. The invention however keeps the pressure in front of impeller and behind the high speed pinion the same even when the guide vanes are closed because now the venting is made to the area 7** downstream of the guide vanes. This reduces the power loss in the thrust bearing when the guide vanes are closed.

While the present invention has been particularly shown and described with reference to the preferred mode as illustrated in the drawing, it will be understood by one skilled in the art that various changes in detail may be effected therein without departing from the spirit and scope of the invention as defined by the claims. For example, it will be understood that the invention includes not just the particular venting passage arrangement of this embodiment (i.e., venting pipe 65 and suction housing cavity 67), but also any other venting passage between the transmission chamber and the compressor suction area downstream of the guide vanes that allows significant pressure differential reduction therebetween during start-up.

We claim:

1. An apparatus for an improved transmission vent system for centrifugal compressors, comprising:

a motor compartment;

a transmission chamber;

an impeller for moving gas in a downstream direction;

a guide vane located upstream of the impeller; and a venting passage connected between the transmission chamber and a compressor suction area upstream of the impeller and downstream of the guide vane.

2. An apparatus for an improved transmission vent system for centrifugal compressors as recited in claim 1, wherein said venting passage includes means for equalizing pressure between said transmission chamber and said area upstream of the impeller and downstream of said guide vane.

3. An apparatus for an improved transmission vent system for centrifugal compressors as recited in claim 1, wherein said venting passage comprises a demister and a venting pipe.

4. An apparatus for an improved transmission vent system for centrifugal compressors as recited in claim 1, wherein said venting passage further comprises a suction housing cavity.

5. A method for manufacturing an improved transmission vent system for centrifugal compressors having a motor compartment, a transmission chamber, an impeller for moving gas in a downstream direction, and a guide vane located upstream of the impeller, comprising the step of:

forming a venting passage to fluidly connect the transmission chamber with a compressor suction area upstream of the impeller and downstream of the guide vane.

* * * * *